US007828114B2

(12) United States Patent
Morita et al.

(10) Patent No.: US 7,828,114 B2
(45) Date of Patent: Nov. 9, 2010

(54) EXHAUST DEVICE FOR MOTORCYCLE ENGINE

(75) Inventors: Kenji Morita, Saitama (JP); Yuichi Tanaka, Saitama (JP); Satoru Nojima, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 63 days.

(21) Appl. No.: 12/043,335

(22) Filed: Mar. 6, 2008

(65) Prior Publication Data

US 2008/0236940 A1 Oct. 2, 2008

(30) Foreign Application Priority Data

Mar. 30, 2007 (JP) ..... 2007-095482

(51) Int. Cl.
*F01N 13/08* (2010.01)

(52) U.S. Cl. ..... 181/228; 181/227; 181/212; 181/237; 181/254; 60/299

(58) Field of Classification Search ..... 181/212, 181/227, 228, 237, 254, 255, 249, 269; 60/299
See application file for complete search history.

(56) References Cited

U.S. PATENT DOCUMENTS 5,943,771 A * 8/1999 Schmitt ..... 29/890
6,241,044 B1 * 6/2001 Nishiyama et al. ..... 181/272
6,336,471 B1 * 1/2002 Feuling ..... 138/39
6,425,742 B1 * 7/2002 Fukuda et al. ..... 417/317
6,598,390 B2 * 7/2003 Chang ..... 60/323
7,328,574 B2 * 2/2008 Vignassa et al. ..... 60/324
2002/0096385 A1 * 7/2002 Kuji et al. ..... 180/309
2003/0057014 A1 * 3/2003 Misaki ..... 181/240
2006/0201742 A1 * 9/2006 Terashima et al. ..... 181/227
2007/0158136 A1 * 7/2007 Shimomura et al. ..... 181/251
2008/0110155 A1 * 5/2008 Harada ..... 60/276

FOREIGN PATENT DOCUMENTS

EP 1 701 009 A1 9/2006
JP 6-50052 B2 6/1994

* cited by examiner

*Primary Examiner*—Jeffrey Donels
*Assistant Examiner*—Forrest M Phillips
(74) *Attorney, Agent, or Firm*—Birch, Stewart, Kolasch & Birch, LLP

(57) ABSTRACT

A muffler for efficiently reducing noise. Front side exhaust pipes and rear side exhaust pipes extend from front cylinders and rear cylinders, respectively, of a V-type water-cooled 4-cylinder engine and are operatively connected to a catalyst chamber disposed below a crankcase. The catalyst chamber is connected to an exhaust chamber located to the rear thereof in which exhaust gas is expanded. An outlet pipe laterally projects from a lateral surface of a rear end portion of the exhaust chamber and is connected to a front pipe projecting from the lateral surface of the front portion of a muffler. The front pipe is transversely inserted into the muffler to increase a cross-section ratio, thereby efficiently reducing noise.

22 Claims, 9 Drawing Sheets

EXHAUST DEVICE FOR MOTORCYCLE ENGINE

CROSS-REFERENCE TO RELATED APPLICATIONS

The present application claims priority under 35 USC 119 to Japanese Patent Application No. 2007-095482 filed on Mar. 30, 2007 the entire contents of which are hereby incorporated by reference.

BACKGROUND OF THE INVENTION

1. Field of the Invention

The present invention relates to exhaust devices for a motorcycle engine and in particular to an exhaust device that improves the noise reduction efficiency of a muffler.

2. Description of Background Art

A plurality of exhaust pipes for a multicylinder engine are known wherein the exhaust pipes are collected, and expansion is performed one time in an exhaust chamber; which is then connected to a muffler. Thus, noise is reduced and the size of the muffler is reduced. See, for example, Japanese Patent Publication No. Hei 6-50052.

Increasing a cross-section ratio is known as a method of improving the noise reduction efficiency of a muffler. More specifically, increasing a ratio between a cross section Sa of an inlet passage of the muffler and a passage-sectional area Sb of an expansion chamber, Sb/Sa, can reduce noise accordingly.

On the other hand, even if the exhaust chamber is provided as in the conventional example, the noise reduction efficiency of the muffler itself cannot be improved. The general structure is that the inlet of a cylindrical muffler is provided at the leading end portion of the muffler so as to face a back and forth direction. Such a structure cannot increase the cross-section ratio so much.

SUMMARY AND OBJECTS OF THE INVENTION

It is an object of an embodiment of the present invention, therefore, to make it possible to increase the noise reduction efficiency by sufficiently increasing a cross-section ratio.

To solve the above problem, according to an embodiment of the present invention, an exhaust device is provided for an motorcycle engine wherein an exhaust device includes an exhaust chamber connected to the downstream side of an exhaust pipe connected to an exhaust hole of an engine. The downstream side of the exhaust chamber is connected to a muffler wherein the exhaust chamber includes an exhaust chamber inlet facing a back and forth direction and an exhaust chamber outlet facing the side. The exhaust chamber outlet is connected to a muffler inlet which is provided, to face the side, at a lateral surface of a front portion of the muffler disposed to extend in the back and forth direction.

According to an embodiment of the present invention, the exhaust chamber is disposed between the lower rear side of the engine and a rear wheel.

According to an embodiment of the present invention, a separator is provided inside of the muffler to partition the inside of the muffler back and forth and is disposed between a central portion, in the back and forth direction, of the muffler and an rear end thereof.

According to an embodiment of the present invention, a catalyst is provided forward of the exhaust chamber.

According to an embodiment of the present invention, the muffler inlet facing the side is provided at the lateral surface of the front portion of the muffler and the exhaust chamber outlet is connected to the muffler inlet. The passage-sectional area of an expansion chamber of the muffler corresponds to a longitudinal cross section cutting through the muffler in the back and forth direction. This longitudinal cross section is larger than a transverse cross section cutting through the muffler in the horizontal direction. Thus, a cross-section ratio can be increased which is a ratio of a passage-sectional area of the expansion chamber of the muffler to a passage-sectional area of the muffler inlet. This can efficiently reduce noise of the muffler.

According to an embodiment of the present invention, since the exhaust chamber is disposed between the lower portion of the engine and the rear wheel, the upper surface of the exhaust chamber can be extended upwardly. Thus, it is not necessary to lower the bottom surface of the exhaust chamber so much and the exhaust chamber can ensure a sufficient minimum ground clearance while sufficiently ensuring the vertical width of the exhaust chamber.

According to an embodiment of the present invention, since the separator is provided on the rear end side with respect to the central portion, on the back and forth direction, of the muffler, the length from the front end of the muffler to the separator can sufficiently be increased to enlarge the passage-sectional area of the expansion chamber of the muffler. This can increase the cross-section ratio to further improve the noise reduction effect.

According to an embodiment of the present invention, since the catalyst is provided separately from and forward of the exhaust chamber, it is possible for the exhaust chamber to play a role of only the expansion chamber, thereby downsizing the expansion chamber accordingly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
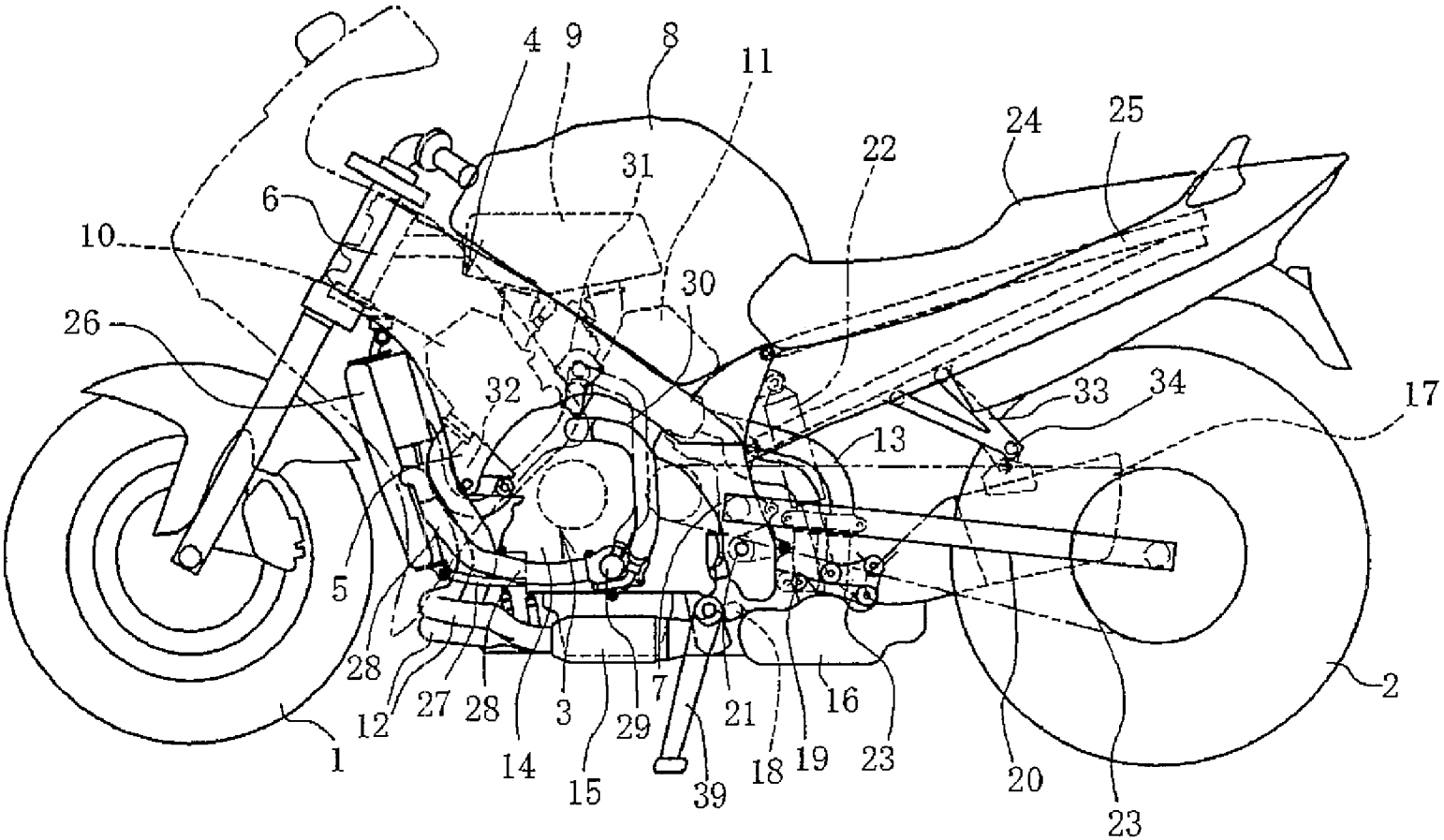
FIG. 1 is a lateral view of a motorcycle according to an embodiment.

FIG. 1 is a lateral view of a motorcycle according to an embodiment of the present invention. The motorcycle is such that a V-type water-cooled 4-cylinder engine 3 is disposed between a front wheel 1 and a rear wheel 2 and supported by a body frame 4.

A hanger 5 is attached to the intermediate portion of the body frame 4 so as to support the front portion of the engine 3. A head pipe 6 is attached to the front end of the body frame 4 and a pivot plate 7 is supported by the rear portion of the body frame 4. A fuel tank 8 is supported on the intermediate portion of the body frame 4 and an air intake box 9 is received inside the front portion of the fuel tank 8.

The air intake box 9 sucks air from the front and supplies the air to front cylinders 10 and rear cylinders 11 located below the air intake box 9. The air intake box 9 is disposed above the valley portion between the front cylinders 10 and the rear cylinders 11.

Front side exhaust pipes 12 extend forwardly from the respective front cylinders 10. Rear side exhaust pipes 13 extend rearwardly from the respective rear cylinders 11. The front side exhaust pipes 12 extend downwardly along the front surface of a crankcase 14 of the engine 3 and are connected, from the front, with a catalyst chamber 15 located below the crankcase 14, via a collecting pipe. Also the rear side exhaust pipes 13 are connected, from the front, with the catalyst chamber 15 via another collecting pipe as described later.

The catalyst chamber 15 connects with an exhaust chamber 16, an expansion chamber, disposed rearward thereof. The exhaust chamber 16 is disposed in a space defined between the lower portion of the crankcase 14 and the rear wheel 2 and connects with a muffler 17 extending on the right side of the rear wheel 2 with respect to the vehicle body. The exhaust chamber 16 is supported by the lower end of the pivot plate 7 at two, front and rear, attachment portions 18, 19.

The muffler 17 is disposed to cross a rear swing arm 20 as viewed from the side. The rear swing arm 20 has a front end portion which is supported by the lower portion of the muffler 17 with the pivot shaft 21 so as to be swingable up and down and is suspended by a rear cushion 22 provided between the upper end of the pivot plate 7 and the rear swing arm 20.

A suspension link 23 is provided between the lower end of the pivot plate 7 and the intermediate portion of the attachment portion 18. The exhaust chamber 16 is disposed below the suspension link 23 so as to avoid the suspension link 23. The front end of the muffler 17 is located at a position approximately equal to that of the suspension link 23 higher, by one step, than the exhaust chamber 16.

The rear wheel 2 is of a shaft drive type and is driven by the engine 3. A seat 24 is supported on a seat rail 25 so as to be located above the rear swing arm 20 and rearward of the fuel tank 8. The seat rail 25 is supported by the pivot plate 7 at its front end.

A radiator 26 is disposed forward of the front cylinders 10 and rearward of the front wheel 1 and has an upper portion suspended and supported by the front portion, of the body frame 4, close to the head pipe 6. The radiator 26 is supported with the head bent forward in which the upper portion is slanted forward. A gap is defined between the radiator 26, and the front cylinders 10 and the crankcase 14. The front side exhaust pipes 12 are vertically passed through the gap.

The lower end of the radiator 26 is supported by the crankcase 14 via a stay 27 extending forward from the front lower portion of the crankcase 14. A feed-water hose 28 extends rearwardly from a lateral tank of the radiator 26 and connects with a feed-water pump 29 provided at the lateral portion of the crankcase 14.

Water is fed from the feed-water pump 29 via a joint hose 30 to a water jacket feed-water portion provided in the valley between the front cylinders 10 and the rear cylinders 11. Then the water is fed from the water jacket feed-water portion to the respective water jackets of the front cylinders 10 and the rear cylinders 11. The water circulates the water jackets to cool the cylinders for heat exchange and the water thus heated is fed to a return hose 32 via a thermostat 31 located above the feed-water portion in the valley between the front cylinders 10 and the rear cylinders 11.

The return hose 32 extends downwardly to the lateral surface of the crankcase 14, then extends forwardly, and connects with the lateral tank of the radiator 26. In this way, the heated water is returned by the return hose 32 to the radiator 26.

Figure 2:
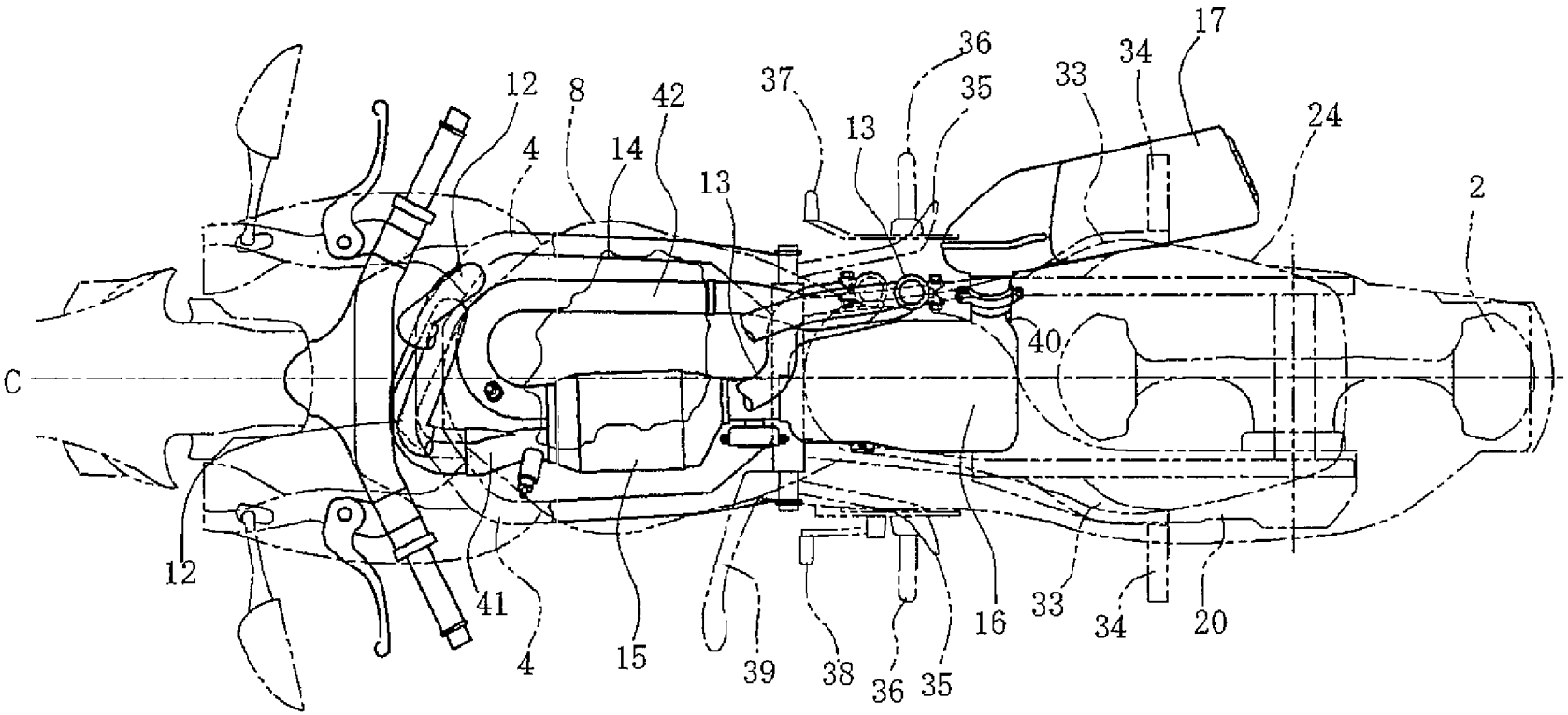
FIG. 2 is a plan view mainly illustrating an exhaust system.

FIG. 2 is a plan view mainly illustrating an exhaust system. The catalyst chamber 15 is disposed to be offset to the left with respect to the body center C and the exhaust chamber 16 is located approximately on the body center C. A laterally-facing outlet pipe 40 is provided at a right-hand rear end portion of the exhaust chamber 16 so as to project to the right outwardly and is joined to the left-lateral surface of the front end of the muffler 17. The muffler 17 is disposed to extend in the back and forth direction and is slanted so that its rear side opens outwardly toward the right side of the vehicle body.

The two front side exhaust pipes 12 are provided in total for the respective left and right cylinders. The front side exhaust pipes 12 extend downwardly and toward the right side of the vehicle body, bending at their lower portions and crossing the vehicle-widthwise direction from the right side of the vehicle body to the left side, collectively join to the collecting pipe 41 and connect with the catalyst chamber 15. In addition, the two rear side exhaust pipes 13 are provided in total for the respective left and right cylinders, extending downwardly, and collectively join to the single rear collecting pipe 42. The rear collecting pipe 42 extends downwardly of and to the right of the crankcase 14 not to interfere therewith, extends from the rear to the front, turning leftward of the vehicle body at a position close to the lower portions of the front side exhaust pipes 12, and connects, from the front, with the catalyst chamber 15 inward of the front collecting pipe 41. The crankcase 14 partially overlaps the catalyst chamber 15 and rear collecting pipe 42 as viewed from above.

A pillion step holder 33 is provided right and left of the vehicle body. The right pillion step holder 33 supports the muffler 17 at its lower end portion. A pillion step 34 and a step holder 35 are supported by the seat rail 25. A brake pedal 37 is provided together with a change pedal 38 and 3*a* side stand 39. These components are supported by the lower portion of the pivot plate 7.

Figure 3:
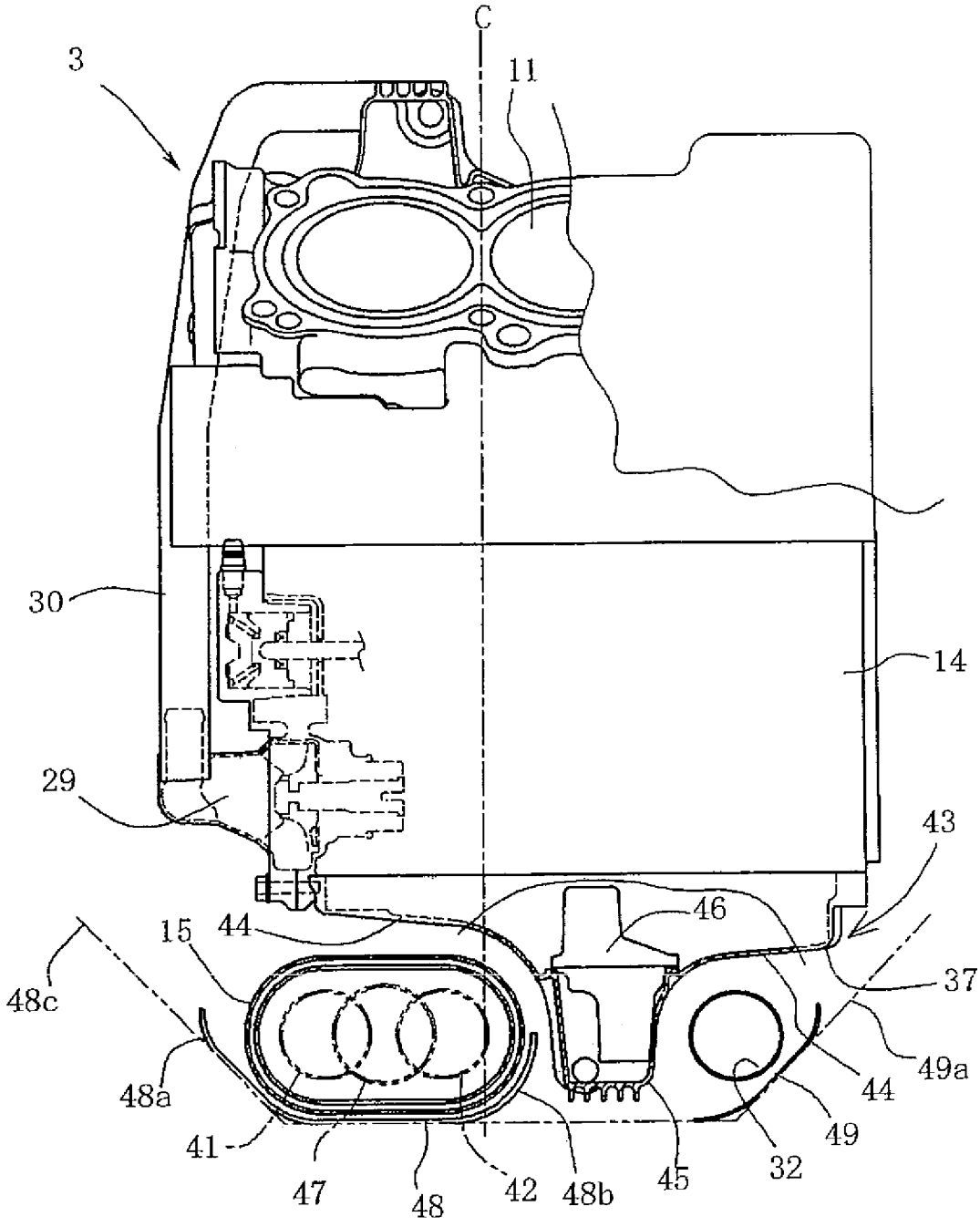
FIG. 3 illustrates an engine from rear.

FIG. 3 illustrates the engine 3 as viewed from the rear. An oil pan 43 is attached to the bottom portion of the crankcase 14. The oil pan 43 is formed to have a curved surface wherein a bottom portion 44 is lower towards the vehicle-widthwise center. The central portion of the bottom portion 44 protrudes lengthwise downwardly to form a reservoir chamber 45. Thus, the oil pan 43 is formed in an almost-T shape as a whole as viewed from the rearward (or as viewed from the front).

Figure 5:
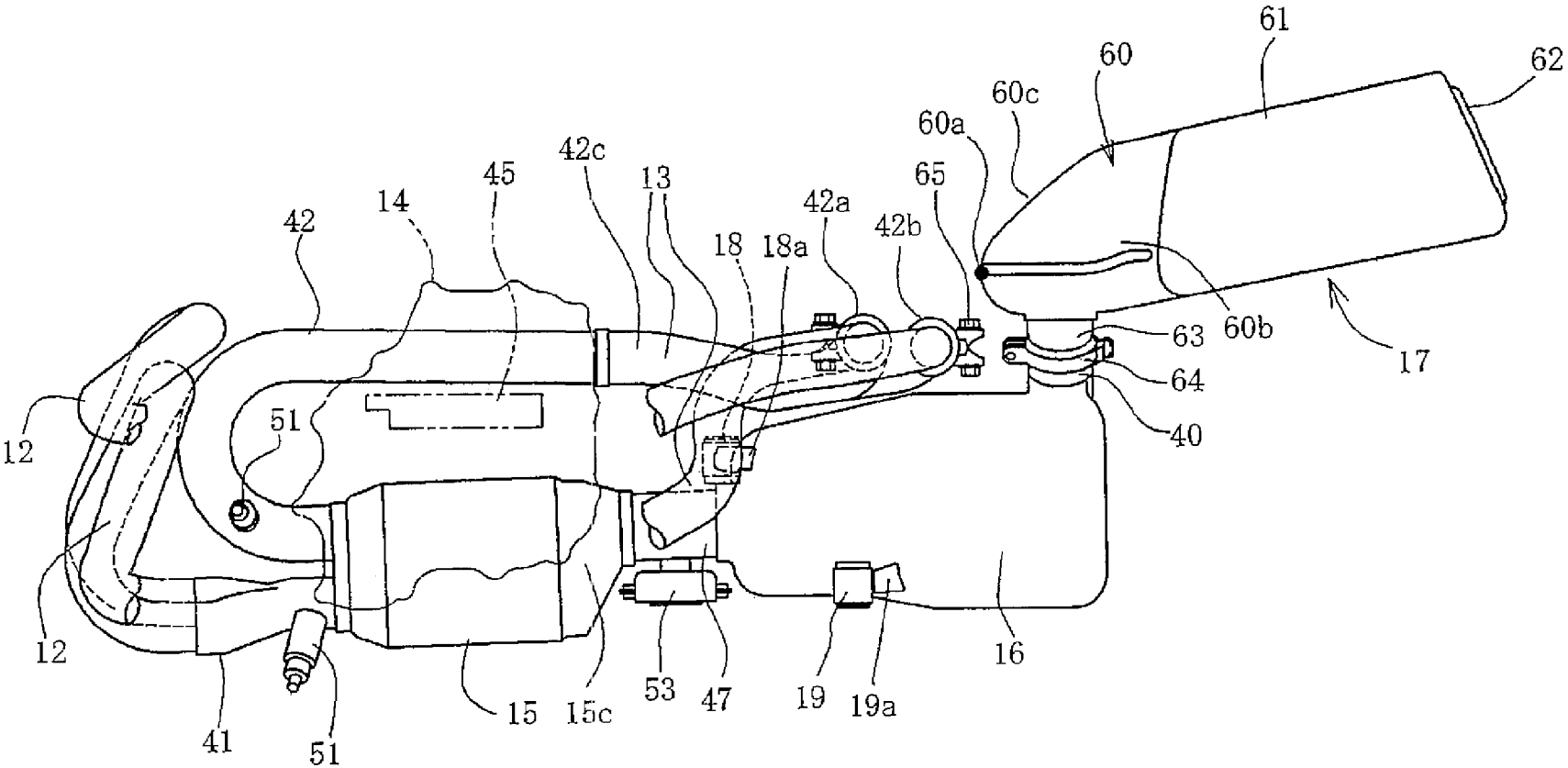
FIG. 5 is a plan view of the exhaust system.

The reservoir chamber 45 is formed deep and elongated in the back and forth direction (see FIG. 5). An arrangement space for the rear collecting pipe 42 and the catalyst chamber 15 is sufficiently widely ensured right and left of the reservoir chamber 45. The upper portion of the reservoir chamber 45 merges with the bottom portion 44 protruding to the right and left so that oil can efficiently be collected into the reservoir chamber 45. A strainer 46 is received in the reservoir chamber 45 so that the oil collected even in the deep reservoir chamber 45 can stably be sucked even when the vehicle body is tilted.

The reservoir chamber 45 is provided at a position slightly offset from the body center C to the right so that a relatively large space is formed below the bottom portion 44 on the left side of the reservoir chamber 45. The catalyst chamber 15 is disposed in the space. A front collecting pipe 41 and a rear collecting pipe 42 are joined to the front surface of the catalyst chamber 15 and a rear exhaust pipe 47 is joined to the rear surface of the catalyst chamber 15. The catalyst chamber 15 is a relatively-flat cylindrical body formed in a horizontally-long circle in cross-section and internally receives a known exhaust purification catalyst with honeycomb structure or the like.

A guard plate 48 is disposed on the under side of the catalyst chamber 15. The guard plate 48 includes left and right bent lateral portions 48*a*, 48*b*, which extend to surround the catalyst chamber 15 from the left and from the right. The right lateral portion 48*b* is formed like a curved surface along the catalyst chamber 15 to enter into between the catalyst chamber 15 and the reservoir chamber 15. The guard plate 48 is disposed to slant along the left bank line 48*c*.

A space slightly smaller than the left-hand space is provided also on the right side of the reservoir chamber 45 and below the bottom portion 44. The single rear collecting pipe 42 is passed through this space in the back and forth direction. Also a guide plate 49 is provided to the right and obliquely downwardly of the rear collecting pipe 42. The guide plate 49 is also disposed to slant along a right-hand bank line 49*a*. The left and right bank lines 48*c*, 49*a* are lines each indicating the bank angle of the vehicle body.

Figure 4:
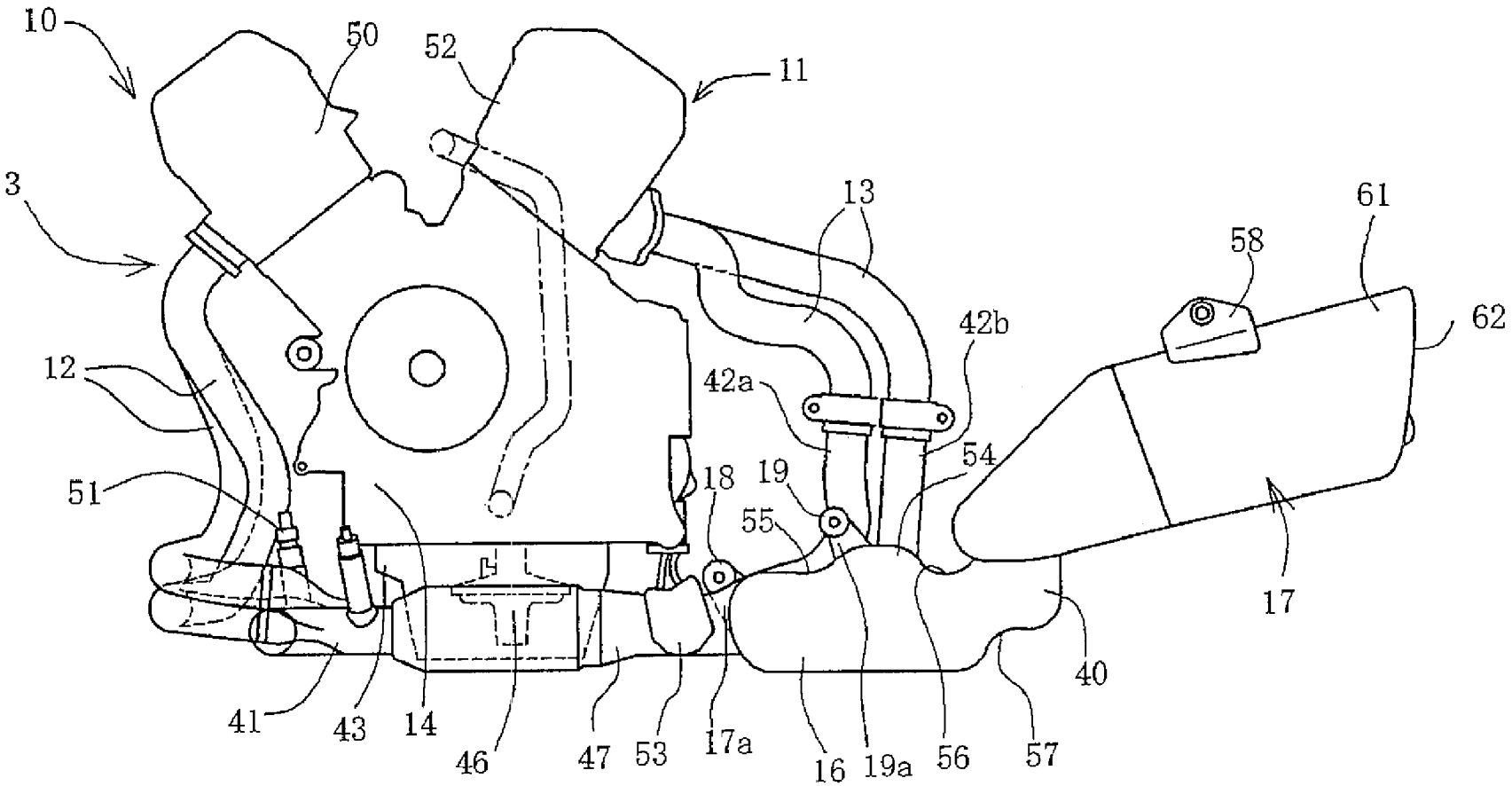
FIG. 4 is a lateral view of the exhaust system.

The exhaust system is hereinafter described in further detail. FIG. 4 is a lateral view of the exhaust system. Cylinder heads 50 of the front cylinders 10 are provided right and left. The two front side exhaust pipes 12 connected to the respective exhaust ports of the cylinder heads 50 extend downwardly in front of the crankcase 14, bending at their lower ends, and are connected with the approximately Y-shaped front pipe 41. The rear side of the front collecting pipe 41 is formed as a single one, which connects with the catalyst chamber 15. An $O_2$ sensor 51 is provided to the right before the joint portion with the catalyst chamber 15 so as to project upwardly from the upper surface thereof.

In addition, another $O_2$ sensor 51 is provided, so as to project upwardly, at a position close to the joint portion between the catalyst chamber 15 and the rear collecting pipe 42 which cannot be seen in the figures because of being superposed by the front collecting pipe 41. The $O_2$ sensor 51 measures oxygen concentration in exhaust gas before purification.

Cylinder heads 52 of the rear cylinders 11 are provided to the right and left. The two rear side exhaust pipes 13, connected to the respective exhaust ports of the cylinder heads 52, extend obliquely downwardly and rearwardly, bending at a position above the exhaust chamber 16, extending approximately vertically downwardly, and are connected with branch portions 42*a*, 42*b* of the rear pipe 42 which is also approximately a Y-shape.

A drive portion of an exhaust valve 53 is provided, so as to be exposed, at the lateral surface of the rear exhaust pipe 47 which connects the rear portion of the catalyst chamber 15 with the front portion of the exhaust chamber 16. The exhaust valve 53 is designed to control an amount of exhaust gas by changing the passage-sectional area of the rear exhaust pipe 47 according to the traveling conditions.

The respective bottom surfaces of the catalyst chamber 15 and the exhaust chamber 16 are located on respective horizontal lines H having approximately the same height to ensure a sufficient minimum ground clearance. However, the vertical width (thickness) of the exhaust chamber 16 is greater than that of the catalyst chamber 15. The exhaust chamber 16 ensures the necessary vertical width by extending the upper surface upwardly. This is enabled by disposing the exhaust chamber 16 in the space put between the lower portion of the engine 3 and the rear wheel from front and from rear and by using the space formed below the rear swing arm 20 (FIG. 1) located above the exhaust chamber 16.

The exhaust chamber 16 is formed with a raised portion 54 at the intermediate portion of the upper surface thereof and recessed portions 55, 56 are respectively provided to be forward of and rearward of the raised portion 54. The recessed portion 55 is adapted to avoid the lower end portion of the pivot plate 7 and similarly the recessed portion 56 is adapted to avoid the suspension link 23.

The attachment portion 18 is provided at the end of a stay 18*a* that projects upwardly from the front end of the exhaust chamber 16. Similarly, the attachment portion 19 is provided at the end of a stay 19*a* that projects upwardly from the raised portion 54 of the exhaust chamber 16. Thus, the exhaust chamber 16 is rubber-mounted to the pivot plate 7. The outlet pipe 40 extends to the rear from the rear end of the exhaust chamber 16 while being reduced in diameter. To form the outlet pipe 40, a recessed portion 57 is formed by reducing the diameter of the rear end portion of the exhaust chamber 16.

The muffler 17 includes a front portion 60 formed in an approximate triangle and a main body portion 61, which are lined and welded integrally with each other. The outlet pipe 40 is joined to the lateral surface of the front portion 60 close to an acute front end portion 60*a* thereof. An upper surface 60*b* of the front portion 60 is formed as a taper surface which extends forwardly and obliquely downwardly. The front end portion 60*a* of the front portion 60 partially overlaps the rear end portion of the exhaust chamber 16 at a portion of the outlet pipe 40.

The main body portion 61 is formed like a tube having an approximately uniform diameter. A rear end portion of the main body portion 61 is closed by an end cap 62 whose upper portion projects to the rear from the other portion. A stay 58 is attached to the pillion step holder 33 (FIG. 1).

FIG. 5 is a plan view of the exhaust system. The front side exhaust pipes 12 have respective lower portions which are bent vehicle-widthwise at a position forward of the rear collecting pipe 42 and overlap one on another. The rear side exhaust pipes 13 overlap one on another along the right-hand surface of the exhaust chamber 16, extending rearwardly to the vicinity of the outlet pipe 40, then bend downward, and are connected with the branch portions 42*a*, 42*b* of the rear collecting pipe 42.

The outlet pipe 40 projects to the right from the internal surface of the rear end portion of the exhaust chamber 16 and is connected to a front pipe 63 with a band 64. The front pipe 63 projects to the left from the internal surface of the front end portion of the front portion 60. In addition, the front pipe 63 serves as an inlet pipe of the muffler 17.

The joint portion between the outlet pipe 40 and the front pipe 63 is located slightly to the rear from the front end portion 60*a* of the front portion 60 of the muffler 17 to form a space. A band 65 that is used to secure a joint portion between the rear side exhaust pipe 13 and the rear collecting pipe 42 partially faces this space. An external surface 60*c* of the front portion 60 of the muffler 17 is formed as a taper surface which slants so that its front side faces the central side of the vehicle body.

An external surface 15*d* of a rear wall 15*c* of the catalyst chamber 15 is formed as a taper surface with a rear side that enters inside the vehicle body and is reduced in diameter to have approximately the same diameter as that of the rear exhaust pipe 47. A recessed space surrounded by the rear wall 15*c* and the front wall 16*a* of the exhaust chamber 16 is formed externally of the rear exhaust pipe 47. The exhaust valve 53 is received in this recessed space to be protected from disturbance such as scattered stones or the like.

Figure 6:
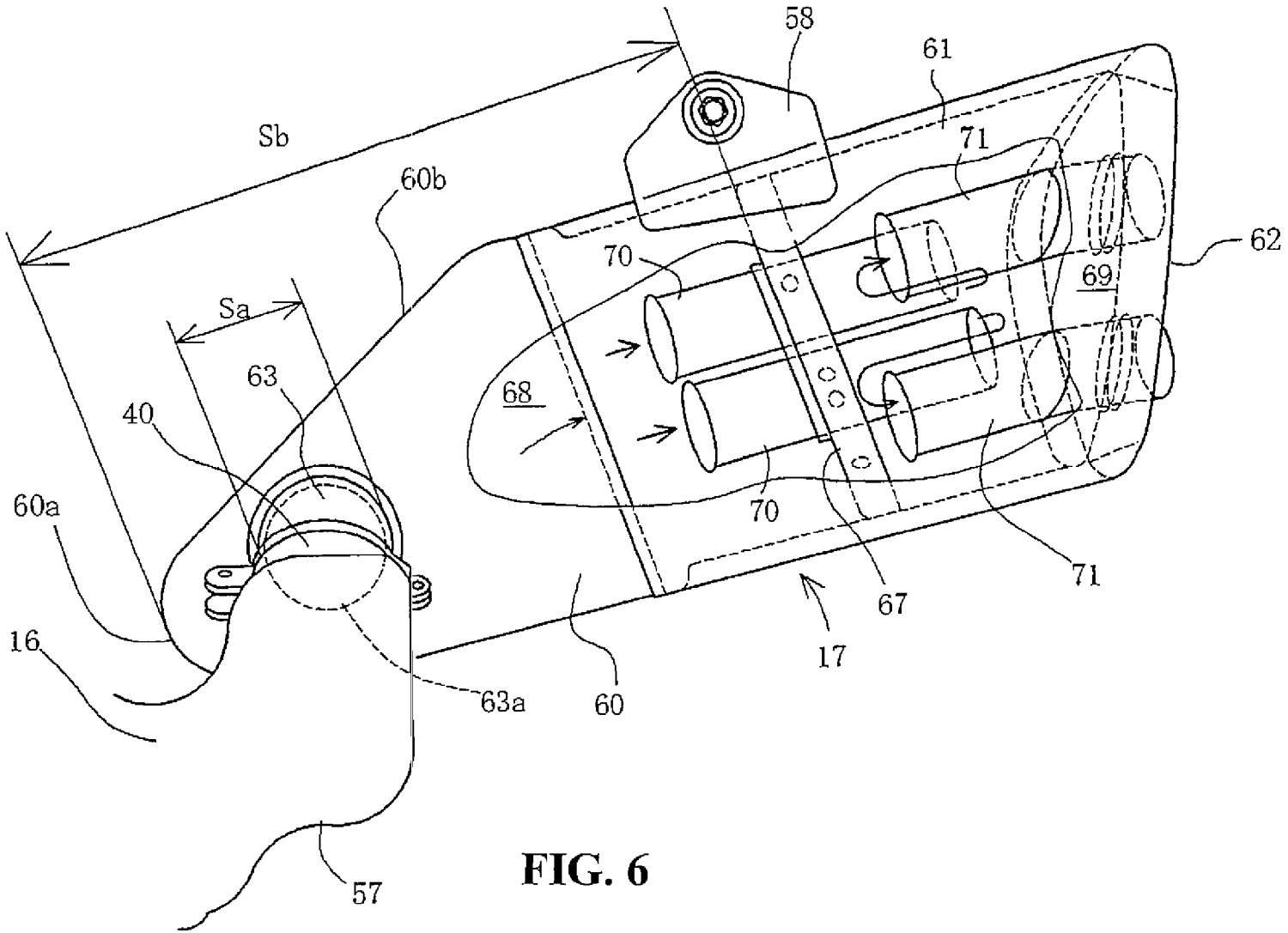
FIG. 6 is an enlarged lateral view illustrating a portion mainly including a muffler.
Figure 7:
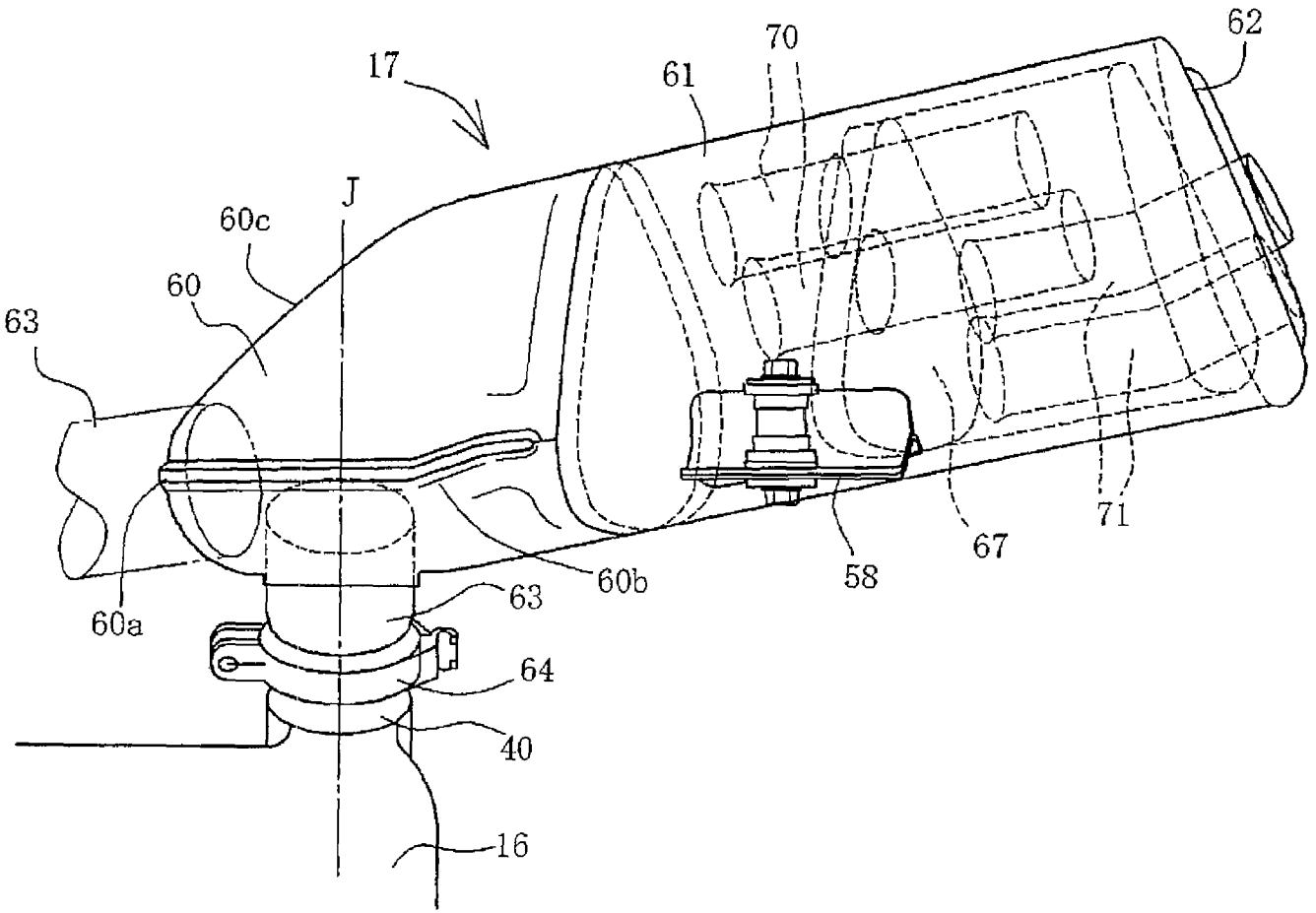
FIG. 7 is an enlarged plan view of FIG. 6.
Figure 8:
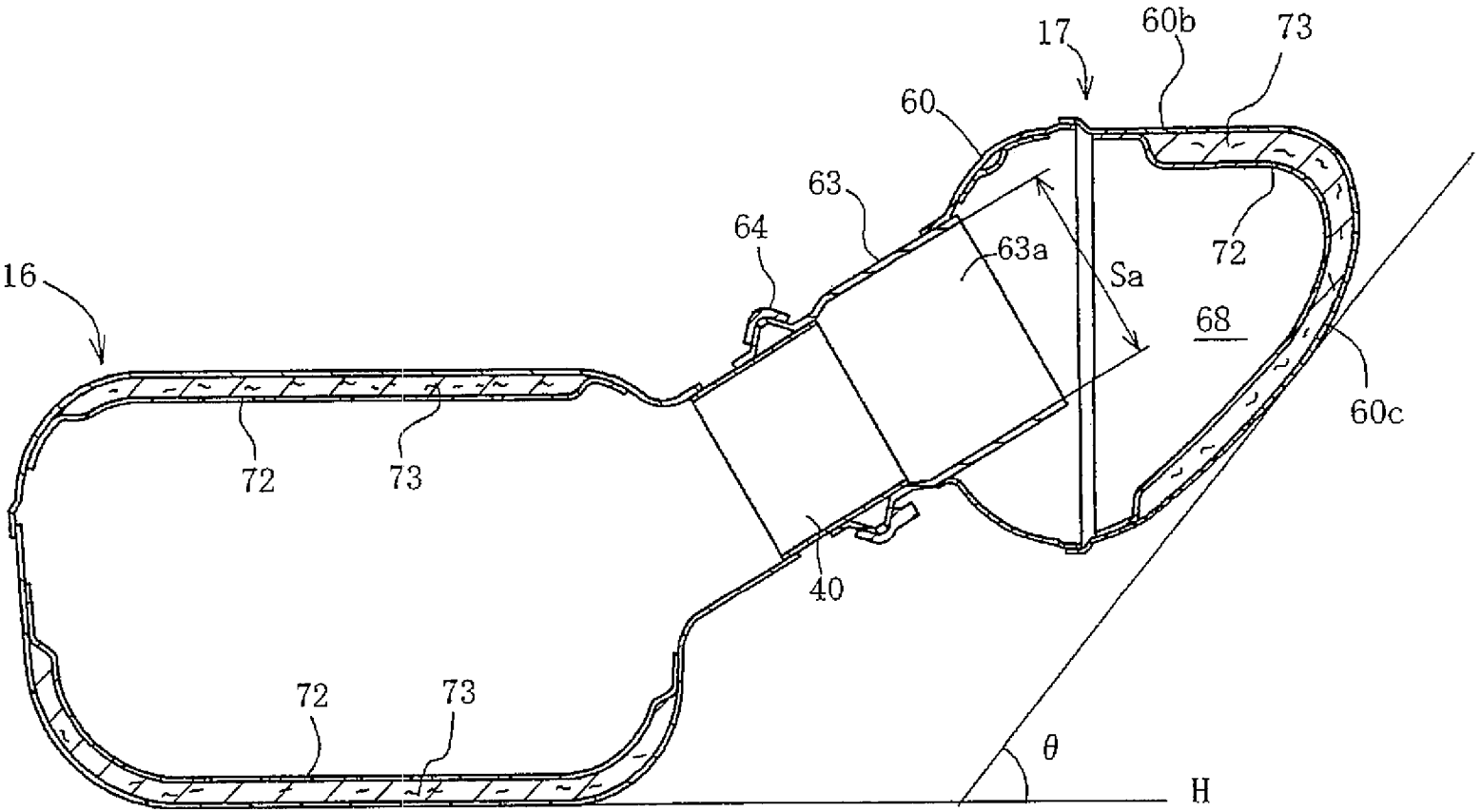
FIG. 8 is a cross-sectional view taken along line 8-8 of FIG. 4.

FIG. 6 is an enlarged lateral view illustrating the muffler 17, inclusive of the joint portion of the outlet pipe 40. FIG. 7 is an enlarged plan view of FIG. 6. FIG. 8 is a cross-sectional view taken along line 8-8 of FIG. 5. Referring to FIGS. 6 and 7, the main body portion 61 is internally partitioned back and forth by a separator 67. A front chamber 68 passing through the inside of the front portion 60 is formed forward of the separator 67. The rear of the separator 67 is formed as a relatively small rear chamber 69 between the separator 67 and the end cap 62.

The separator 67 is provided with two, upper and lower, communication pipes 70 which pass through the separator 67 back and forth to allow the front chamber 68 and the rear chamber 69 to communicate with each other. The end cap 62 is provided with two, upper and lower, tail pipes 71 which pass through the end cap 62 back and forth. The tail pipes 71 are disposed to be to the left and offset from the axes of the communication pipes 70. The front portions of the tail pipes 71 overlap from the right the rear end side portion of a portion, of each communication pipe 70, located inside the rear chamber 69.

The front end of the upper tail pipe 71 is located at a position rearward of the separator 67. The front end of the lower tail pipe 71 is located at a position close to the separator 67. The rear end portions of the tail pipes 71 slightly project from the end cap 62, bending to the right, and are opened to the atmosphere.

Referring to FIG. 8, the exhaust chamber 16 and the front portion 60 of the muffler 17 are arranged at respective different levels so that the front portion 60 is higher than the exhaust chamber 16. The outlet pipe 40 projecting obliquely upwardly is fitted at its leading end into the front pipe 63 projecting obliquely downwardly. In this way, the outlet pipe 40 and the front pipe 63 are joined to communicate with each other so that the muffler 17 introduces exhaust gas from the front pipe 63 in a transverse insertion manner.

Sound absorbing materials 73 are fixed to the respective inner surfaces of the upper surface and bottom surface of the exhaust chamber 16 by punching metals 72. Also sound absorbing materials 73 are provided on the inner surfaces of the front portion 60 by punching metals 72 so as to cover from the upper surface 60*b* to the external surface 60*c*.

The front portion 60 is formed in an appropriate inverted triangle in cross-section. The right lateral surface 60*c* is formed as a slant surface so that its lower portion faces the inside of the vehicle body, thereby providing a bank angle θ. Symbol H denotes a horizontal line coincident with the bottom surface of the exhaust chamber 16.

In the figures, exhaust gas entering the front pipe 63 from the exhaust chamber 16 through the outlet pipe 40 passes through the front pipe 63 and enters the front chamber 68 via the front portion 60 for expansion. Thereafter, the exhaust gas passes through the communication pipes 70 while being compressed again, and enters the rear chamber 69. The exhaust gas is again expanded in the rear chamber 69 and flows forwardly toward the separator 67. Thereafter, the exhaust gas enters the tail pipes 71 from the front ends thereof and flows rearward again, being discharged from the rear ends of the tail pipes 71 to the atmosphere. During this time, the plurality of expansions and the sound absorbing materials 73 sufficiently reduce exhaust noise.

The large cross-section ratio of the front chamber 68 makes an effect of reducing the exhaust noise significantly. As shown in FIG. 6, when the exhaust gas from the front pipe 63 expands in the front chamber 68, as viewed along the axis J (FIG. 7) of the front pipe 63, the passage-sectional area of the front chamber 68 in which the exhaust gas expands corresponds to the range, indicated with symbol Sb, from the front end 60*a* to the separator 67. Thus, if the passage-sectional area of the front pipe 63 is Sa, the exhaust gas expands from Sa to Sb, and thus, the cross-section ratio Sb/Sa is significantly large. More specifically, this embodiment can provide about 7.0.

If the front pipe 63 is joined to the front portion 60 from the front thereof as in the traditional way indicated with imaginary lines in FIG. 7, the cross-section of the front portion 60 taken along the axis J of the front pipe 63 is taken as a passage-sectional area in the expansion of this case. In this case, the cross-section ratio is about 4.0. Thus, the transverse insertion of the present embodiment provides the cross-section ratio greater than about 75% than the conventional one, thereby effectively reducing the magnitude of noise according to the increased cross-section ratio.

Figure 9:
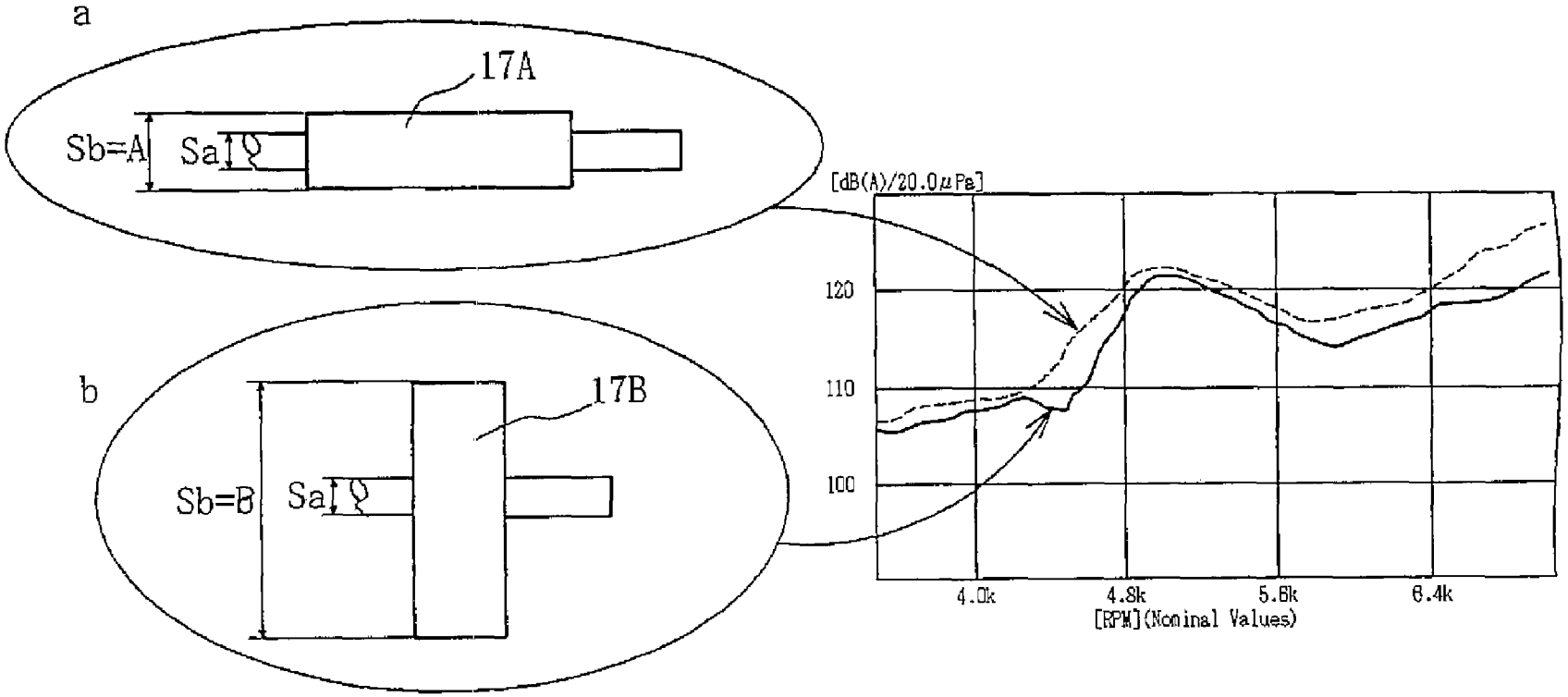
FIG. 9 illustrates the principle of noise reduction due to a cross-section ratio.

FIG. 9 illustrates the principle of noise reduction due to a cross-section ratio. In FIG. 9, two mufflers 17A and 17B are illustrated with different cross sections are joined to a common front pipe.

Symbol "a" indicates an example using an elongated muffler 17A and corresponds to the conventional example mentioned above. Symbol "b" indicates an example using a thick and short muffler 17B and corresponds to the transverse insertion type of the present invention. In addition, the capacities of the mufflers 17A, 17B are the same and also the passage-sectional areas of the front pipes 63 are the same. In addition, the respective passage-sectional areas Sb of the mufflers 17A, 17B are A and B, respectively, and A<<B.

The cross-section ratios of this case are:

$$Sb/Sa=A/Sa<<B/Sa$$

The measurements of exhaust noise of such cases provide the graph on the right side of the figure, which shows that the greater cross-section ratio reduces the noise to a greater extent. In short, if the cross-section ratio is increased, noise can efficiently be reduced accordingly.

The operation of the present embodiment is next described. The front pipe 63 which is a muffler inlet facing the left projects from the lateral surface of the front end portion of the front portion 60 included in the muffler 17. The outlet pipe 40 which is an exhaust chamber outlet projecting to the right from the rear end portion of the exhaust chamber 16 is joined to the front pipe 63. Thus, the passage-sectional area Sb of the front chamber 68, serving as an expansion chamber, of the muffler 17 is an area of a longitudinal cross-section cutting through the front chamber 68 of the muffler 17 in the back and forth direction. This can increase the cross-section ratio Sb/Sa of the expansion chamber of the muffler, which is obtained by dividing the passage-sectional area Sb of the front chamber 68 by the passage-sectional area Sa of the front pipe 63, thereby efficiently reducing the noise of the muffler 17.

In this case, the separator 67 of the muffler 17 is disposed on the rear end side of the central portion, of the muffler 17, in the back and forth direction. Thus, the length from the front end 60*a* of the front portion 60 to the separator 67 is sufficiently increased to enlarge the passage-sectional area of the front chamber 68. This increases the cross-section ratio, thereby increasing the noise reduction effect.

The exhaust chamber 16 is disposed between the rear wheel 2 and the lower rear end of the crankcase 14 which is a lower portion of the engine 3. Thus, the upper surface of the exhaust chamber 16 can be extended upwardly. Consequently, the bottom surface of the exhaust chamber 16 can be made at the same height, of about the horizontal line H, as that of the bottom surface of the catalyst chamber 15. More specifically, it is not necessary to lower the bottom surface of the exhaust chamber 16 so much. Thus, the bottom surface of the exhaust chamber 16 can ensure a sufficient minimum ground clearance while sufficiently ensuring the vertical width of the exhaust chamber 16.

In addition, since the exhaust chamber 16 is provided separately from and forward of the catalyst chamber 15, it is not necessary to provide a catalyst inside the exhaust chamber 16, making it possible for the exhaust chamber 16 to play a role of only an expansion chamber. Thus, the exhaust chamber can be made small accordingly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device for a motorcycle engine, in which an exhaust chamber is connected to a downstream side of an exhaust pipe connected to an exhaust of an engine and a downstream side of the exhaust chamber is connected to a muffler, comprising:

an exhaust chamber inlet facing a back and forth direction; and an exhaust chamber outlet facing a side;

said muffler including a front portion formed in an approximate triangle and a main body, the front portion is closed to an acute front end portion with an upper surface of the front portion being formed as a taper surface extending forwardly and obliquely downwardly;

said exhaust chamber outlet being connected to a muffler inlet which is provided, to face the side, at a lateral surface of the front portion of the muffler disposed to extend in the back and forth direction;

a separator is provided inside of the muffler to partition the inside of the muffler into a front chamber and a rear chamber, said separator being disposed in a central portion of the muffler wherein exhaust gas expands in the front portion of the muffler along the muffler to the separator for providing an increased area for the exhaust gas to expand, wherein at least one communication pipe starts within the front chamber of the muffler, passes through the separator, and ends within the rear chamber such that the exhaust gas in the front chamber of the muffler and the rear chamber of the muffler communicates with each other, wherein the front end portion of the front portion of the muffler partially overlaps a rear portion of the exhaust chamber at a portion of the exhaust chamber outlet, and wherein a laterally-facing outlet pipe is provided at a right-hand side of the rear end portion of the exhaust chamber so as to project rightward outwardly and is joined to a left-lateral surface of a front end of the muffler.

2. The exhaust device for the motorcycle engine according to claim 1, wherein the exhaust chamber is disposed between the lower rear side of the engine and a rear wheel.

3. The exhaust device for the motorcycle engine according to claim 1, wherein a catalyst is provided forward of the exhaust chamber.

4. The exhaust device for the motorcycle engine according to claim 3, wherein said exhaust pipe includes a downstream end operatively connected to said catalyst and said catalyst includes a downstream end operatively connected to said exhaust chamber.

5. The exhaust device for the motorcycle engine according to claim 4, wherein said catalyst includes a relatively-flat cylindrical body formed in a horizontally-long circle in cross-section and internally receives an exhaust purification catalyst with a honeycomb structure.

6. The exhaust device for the motorcycle engine according to claim 1, and further including an exhaust valve operatively connected between a rear portion of the exhaust pipe which connects a rear portion of the catalyst chamber with a front portion of the exhaust chamber for controlling the exhaust gas by changing the passage-sectional area of the rear exhaust pipe based on predetermined operational conditions.

7. The exhaust device for the motorcycle engine according to claim 6, wherein the exhaust chamber is formed with a raised portion at an intermediate portion of an upper surface thereof and recessed portions provided forward and rearwardly of the raised portion.

8. The exhaust device for the motorcycle engine according to claim 7, and further including a first attachment portion provided at an end of a stay upwardly projecting from the front end of the exhaust portion and a second attachment portion provided at an end of a stay upwardly projecting from the raised portion of the exhaust chamber, wherein the exhaust chamber is rubber-mounted to a pivot plate.

9. The exhaust device for the motorcycle engine according to claim 1, wherein the exhaust chamber outlet is an outlet pipe projecting obliquely upwardly that mates with a front pipe extending from the muffler that projects obliquely downwardly for introducing exhaust gas from the exhaust chamber in a transverse manner into a large cross-sectional front chamber of the muffler for reducing exhaust noise wherein ratio of a cross-sectional area of the front pipe as compared to the large cross-sectional front chamber of the muffler is at least 7.0.

10. The exhaust device for the motorcycle engine according to claim 1, wherein an end cap is provided at a rear end of the rear chamber of the muffler, and at least on tail pipe starts within the rear chamber, passes through the end cap, and ends outside of the muffler.

11. The exhaust device for the motorcycle engine according to claim 10, wherein the tail pipe is offset from an axis of the communication pipe, and is overlapped with the communication pipe within the rear chamber along a direction of the axis of the communication pipe.

12. An exhaust device for a motorcycle engine, comprising:

an exhaust pipe operatively connected to an exhaust of an engine;

an exhaust chamber connected to a downstream side of an exhaust pipe;

a muffler connected to a downstream side of the exhaust chamber;

an exhaust chamber inlet extending in a front and back direction;

an exhaust chamber outlet extending to a side and formed to be transverse relative to the exhaust chamber;

said muffler including a front portion formed in an approximate triangle and a main body, the front portion is closed to an acute front end portion with an upper surface of the front portion being fanned as a taper surface extending forwardly and obliquely downwardly;

a lateral surface of a front portion of the muffler being operatively connected to said exhaust chamber outlet provided on the side of the exhaust chamber with a lateral surface of the front portion of the muffler disposed to extend in the back and forth direction; and a separator is provided inside of the muffler to partition the inside of the muffler into a front chamber and a rear chamber, said separator being disposed in a central portion of the muffler wherein exhaust gas expands in the front portion of the muffler along the muffler to the separator for providing an increased area for the exhaust gas to expand, wherein at least one communication pipe starts within the front chamber of the muffler, passes through the separator, and ends within the rear chamber such that the exhaust gas in the front chamber of the muffler and the rear chamber of the muffler communicates with each other.

13. The exhaust device for the motorcycle engine according to claim 12, wherein the exhaust chamber is disposed between the lower rear side of the engine and a rear wheel.

14. The exhaust device for the motorcycle engine according to claim 12, wherein a catalyst is provided forward of the exhaust chamber.

15. The exhaust device for the motorcycle engine according to claim 14, wherein said exhaust pipe includes a downstream end operatively connected to said catalyst and said catalyst includes a downstream end operatively connected to said exhaust chamber.

16. The exhaust device for the motorcycle engine according to claim 15, wherein said catalyst includes a relatively-flat cylindrical body formed in a horizontally-long circle in cross-section and internally receives an exhaust purification catalyst with a honeycomb structure.

17. The exhaust device for the motorcycle engine according to claim 12, and further including an exhaust valve operatively connected between a rear portion of the exhaust pipe which connects a rear portion of the catalyst chamber with a front portion of the exhaust chamber for controlling the exhaust gas by changing the passage-sectional area of the rear exhaust pipe based on predetermined operational conditions.

18. The exhaust device for the motorcycle engine according to claim 17, wherein the exhaust chamber is formed with a raised portion at an intermediate portion of an upper surface thereof and recessed portions provided forward and rearwardly of the raised portion.

19. The exhaust device for the motorcycle engine according to claim 18, and further including a first attachment portion provided at an end of a stay upwardly projecting from the front end of the exhaust portion and a second attachment portion provided at an end of a stay upwardly projecting from the raised portion of the exhaust chamber, wherein the exhaust chamber is rubber-mounted to a pivot plate.

20. The exhaust device for the motorcycle engine according to claim 12, wherein the exhaust chamber outlet is an outlet pipe projecting obliquely upwardly that mates with a front pipe extending from the muffler that projects obliquely downwardly for introducing exhaust gas from the exhaust chamber in a transverse manner into a large cross-sectional front chamber of the muffler for reducing exhaust noise wherein a ratio of a cross-sectional area of the front pipe as compared to the large cross-sectional front chamber of the muffler is at least 7.0.

21. The exhaust device for the motorcycle engine according to claim 12, wherein an end cap is provided at a rear end of the rear chamber of the muffler, and at least on tail pipe starts within the rear chamber, passes through the end cap, and ends outside of the muffler.

22. The exhaust device for the motorcycle engine according to claim 21, wherein the tail pipe is offset from an axis of the communication pipe, and is overlapped with the communication pipe within the rear chamber along a direction of the axis of the communication pipe.

* * * * *